US006991228B2

(12) United States Patent
Schaareman et al.

(10) Patent No.: US 6,991,228 B2
(45) Date of Patent: Jan. 31, 2006

(54) SHEET DEPOSITING DEVICE

(75) Inventors: Henricus Johannes Schaareman, Egchel (NL); Christophorus Lambertus Spoorenberg, Venlo (NL)

(73) Assignee: Oce-Technologies, B.V., Ma Venlo (NL)

( * ) Notice: Subject to any disclaimer, the term of this patent is extended or adjusted under 35 U.S.C. 154(b) by 166 days.

(21) Appl. No.: 10/400,546

(22) Filed: Mar. 28, 2003

(65) Prior Publication Data

US 2003/0184011 A1 Oct. 2, 2003

(30) Foreign Application Priority Data

Mar. 29, 2002 (EP) ..... 02076337

(51) Int. Cl.
*B65H 31/26* (2006.01)

(52) U.S. Cl. ..... 271/220; 271/224

(58) Field of Classification Search ..... 271/220, 271/224, 294, 298, 292; 414/791.2
See application file for complete search history.

(56) References Cited

U.S. PATENT DOCUMENTS

| | | | | |
|---|---|---|---|---|
| 1,573,414 A | * | 2/1926 | Mahoney | 271/208 |
| 3,647,045 A | | 3/1972 | Wegener | |
| 3,698,709 A | * | 10/1972 | Heal et al. | 271/183 |
| 4,061,331 A | | 12/1977 | Habich | |
| 4,828,246 A | * | 5/1989 | Wegel et al. | 271/182 |
| 5,026,034 A | * | 6/1991 | Russel et al. | 271/220 |
| 5,228,679 A | | 7/1993 | Borostyan | |
| 5,249,793 A | * | 10/1993 | Scheufler | 271/220 |
| 6,588,744 B2 | * | 7/2003 | Ries et al. | 271/220 |

FOREIGN PATENT DOCUMENTS

| | | | |
|---|---|---|---|
| DE | 1 090 578 B | | 10/1960 |
| EP | 0 491 970 A1 | | 7/1992 |
| EP | 495448 A2 | * | 7/1992 |
| GB | 2215313 A | * | 9/1989 |
| JP | 60232366 A | * | 11/1985 |
| JP | 61166463 A | * | 7/1986 |
| JP | 02043171 A | * | 2/1990 |
| JP | 06048639 A | * | 2/1994 |

OTHER PUBLICATIONS

Braen, et al. IBM Technical Disclosure Bulletin, vol. 7, no. 8, Jan. 1965, p. 714. XP002212088.

* cited by examiner

*Primary Examiner*—Donald P. Walsh
*Assistant Examiner*—Matthew J. Kohner
(74) *Attorney, Agent, or Firm*—Birch, Stewart, Kolasch & Birch, LLP

(57) ABSTRACT

A sheet depositing device for depositing sheets or sets of sheets fed sequentially from a paper processing apparatus onto a depositing platform and against a depositing registration barrier, the sheet depositing device including a sheet catcher adapted to rest on said depositing platform or adapted to rest on sheets stacked on the depositing platform, the sheet catcher being movable in a direction substantially perpendicular to the depositing platform and engaging the leading edge of incoming sheets before they abut with the depositing registration barrier, and further containing a sheet engaging member suspended from the sheet catcher.

23 Claims, 9 Drawing Sheets

SHEET DEPOSITING DEVICE

BACKGROUND OF THE INVENTION

This nonprovisional application claims priority under 35 U.S.C. § 119(a) on Patent Application No. 02076337.1 filed in Europe on Mar. 29, 2002, which is herein incorporated by reference.

FIELD OF THE INVENTION

The present invention relates to a sheet-depositing device for depositing sheets or sets of sheets fed from a paper processing apparatus sequentially onto a stacking platform and against a registration barrier. The invention relates in particular to a sheet-depositing device provided with sheet catchers.

BACKGROUND ART

U.S. Pat. No. 4,061,331 discloses a sheet depositing device having a platform upon which documents are sequentially stacked. The apparatus also has document elevatable sheet catchers which form a throat for catching or trapping the leading edge of each document during feeding of the sheets onto the platform. The platform can be raised about its receiving end for providing a base for receiving the documents in essentially the same plane in which they are fed into the apparatus. The sheet catchers have side plates and upswept tops and are slideable upwardly in guides under the influence of incoming documents. During the initial stage of a feeding cycle, the documents are fed onto the platform at a low velocity. By controlling the elevation of the platform during this stage, curling problems are minimized. The sheet catchers extend toward the incoming documents only a sufficient extent to trap the leading edge of each document before the document is totally under the influence of printing station exit rollers. When the leading edge has been trapped, the final stage of the feeding cycle begins and the document is accelerated to a high velocity by the printing station exit rollers. This causes the document to be forced under the sheet catchers and the sheet catchers to be elevated. The frictional force applied by the sheet catchers to the leading edge of the incoming sheet both decelerates the sheet until it abuts with the registration barrier, and prevents bouncing back from the registration barrier. It has been observed though, that the sheets stacked on the depositing platform tend to curl up against the registration barrier and push the sheet catchers further up. Thus, the throat is widened and therefore the leading edge of incoming sheets will not be properly placed into contact with the guide surface of the sheet catchers. Thus, the leading edge hits the registration barrier with a high velocity and tends to bounce back. The sheet is not slowed down in its reversed movement by a sufficient frictional force because it is not in proper contact with the guide surface of the sheet catchers. The result is an untidy stack.

U.S. Pat. No. 6,311,971 discloses a sheet depositing device in which individual sheets exiting a printer or other imaging device are moved towards an eccentric member, which rotates in coordination with the element moving the sheet. The eccentric member has a high surface and a low surface. As the sheet reaches the eccentric member, the high surface is located to contact the paper and pushes it downwards. The sheet is then moved into a clamp, the facing surface of which is at an acute angle, which guides the paper downwards. Preferably, the sheet is moved against a first reference surface before it is moved perpendicularly to the first reference surface into the clamp to encounter a second reference surface. The clamp is resiliently mounted lightly so as to allow an entering sheet to push the clamp open. Upon entering the clamp, the sheet encounters the second reference surface. Alternatively, the clamped paper may be pushed perpendicularly to the clamp surface against a reference surface.

Both alternatives form a uniform stack of previous and subsequent sheets, which are moved in the same manner. After the movement of a sheet to the clamp member, the eccentric member rotates so that its low surface is towards the paper exit. The low surface does not extend to encounter sheets exiting the printer, so the next sheet can fall to be moved against the clamp and the reference surface as described. This stacking apparatus flattens the curl of the sheet actually being fed onto the platform, i.e. before it has been deposited. It does, however, not solve the above-described problem that occurs when a stack curls up against the registration barrier. Further, it requires an eccentric member driven in coordination with the incoming sheet.

DISCLOSURE OF THE INVENTION

On this background, it is an object of the present invention to provide a sheet depositing device of the kind referred to initially, which overcomes the above-mentioned problem. This object is achieved by providing a sheet engaging member suspended from the sheet catcher. The suspended sheet engaging member rests on the stack even when the stack is curled up towards the registration barrier and the leading edge of the incoming sheets will be caught by the suspended sheet engaging member.

Preferably, the sheet engaging member is freely suspended from the sheet catcher. If required the sheet engaging member can engage the sheets with a higher force, by being resiliently suspended from the sheet catcher.

The sheet catcher rests on the depositing platform or the stacked sheets via a roller that allows relative lateral movement between the depositing platform and the sheet catcher without applying any substantial lateral force to the sheets. The roller is preferably shaped as a spherical segment or as a conical frustum for providing a sloping surface guiding the leading edge of incoming sheets under the roller.

The sheet engaging member may comprise a tongue, which is preferably pivotally suspended from the end portion of the sheet catcher. The sheet engagement surface of the tongue is preferably sloped to form a throat for trapping the leading edge of incoming sheets.

According to one embodiment of the present invention, the sheet engagement surface of the sheet engaging element is covered with a felt fabric having a low friction coefficient in the direction in which the sheets are fed and a high friction coefficient in the opposite direction to improve the deceleration and anti-bounce back characteristics of the sheet catcher. The sheet catcher may be movable along a guide. Also the sheet depositing platform may be movable along the guide. The sheet depositing device may comprise two or more parallel guides, and be provided with a plurality of superposed depositing platforms and sheet catchers.

Further objects, features, advantages and properties of the bearing, shell and production methods according to the present invention will become apparent from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Expediently, the sheet depositing device is located at the output of a paper processing machine. The sheet depositing device will hereinafter be illustrated with a paper processing machine in the form of a printing apparatus. It is evident, that the sheet depositing device could be operated together with any other type of paper processing apparatus, such as copiers, imaging devices, etc.

Figure 1:
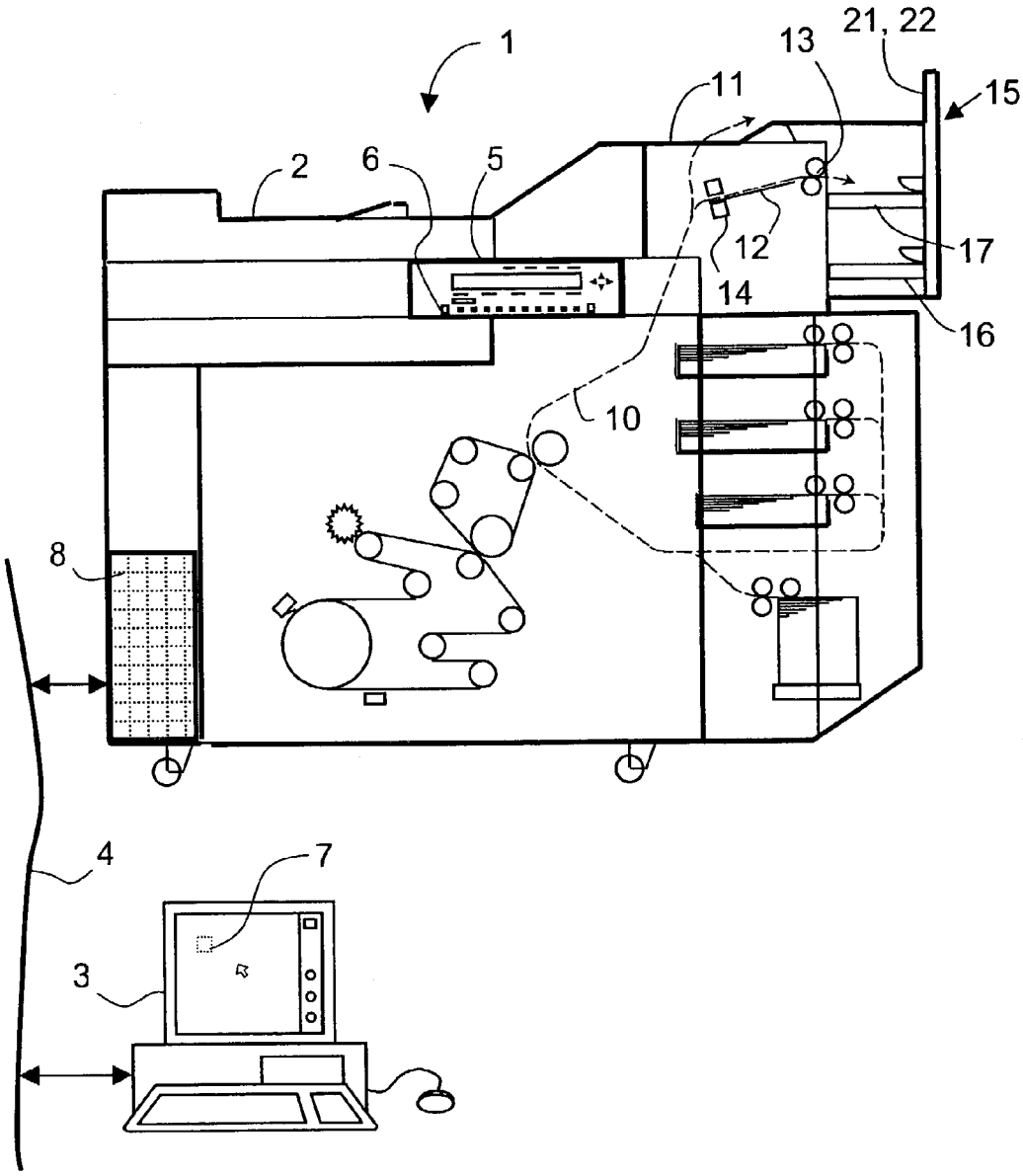
FIG. 1 illustrates one embodiment of the a sheet depositing device in combination with a printing apparatus.

The printing apparatus 1 shown in FIG. 1 comprises means known per se for printing an image on a receiving sheet. These images for printing may be present on original documents which are fed to a scanning station 2 situated at the top of the printing apparatus 1. Images for printing can also be fed in digital form from a workstation 3 connected via a network 4 to a control device 8 of the printing apparatus 1. A printing cycle for copying an original set fed via the scanning station 2 is started by actuating a start button 6 on the operator control panel 5 of the printing apparatus 1.

A printing cycle for printing an image set fed via workstation 3 can be started by actuating a start button 7 provided on the workstation 3, via control device 8 or by actuating a start button 6 provided on the operator control panel 5 of the printing apparatus 1.

In the printing apparatus 1 shown in FIG. 1, the sheet transport path 10 forms the path for delivering to a sheet finishing station 11 the sheets printed in the printing apparatus.

The finishing station 11 contains a sheet collecting tray 12 (not shown in detail) in which a number of printed sheets belonging to a set can be collected and stapled by a stapler 14, whereafter discharge roller pairs 13 feed the set to a sheet depositing device 15 forming part of a sheet depositing station 11.

Figure 2:
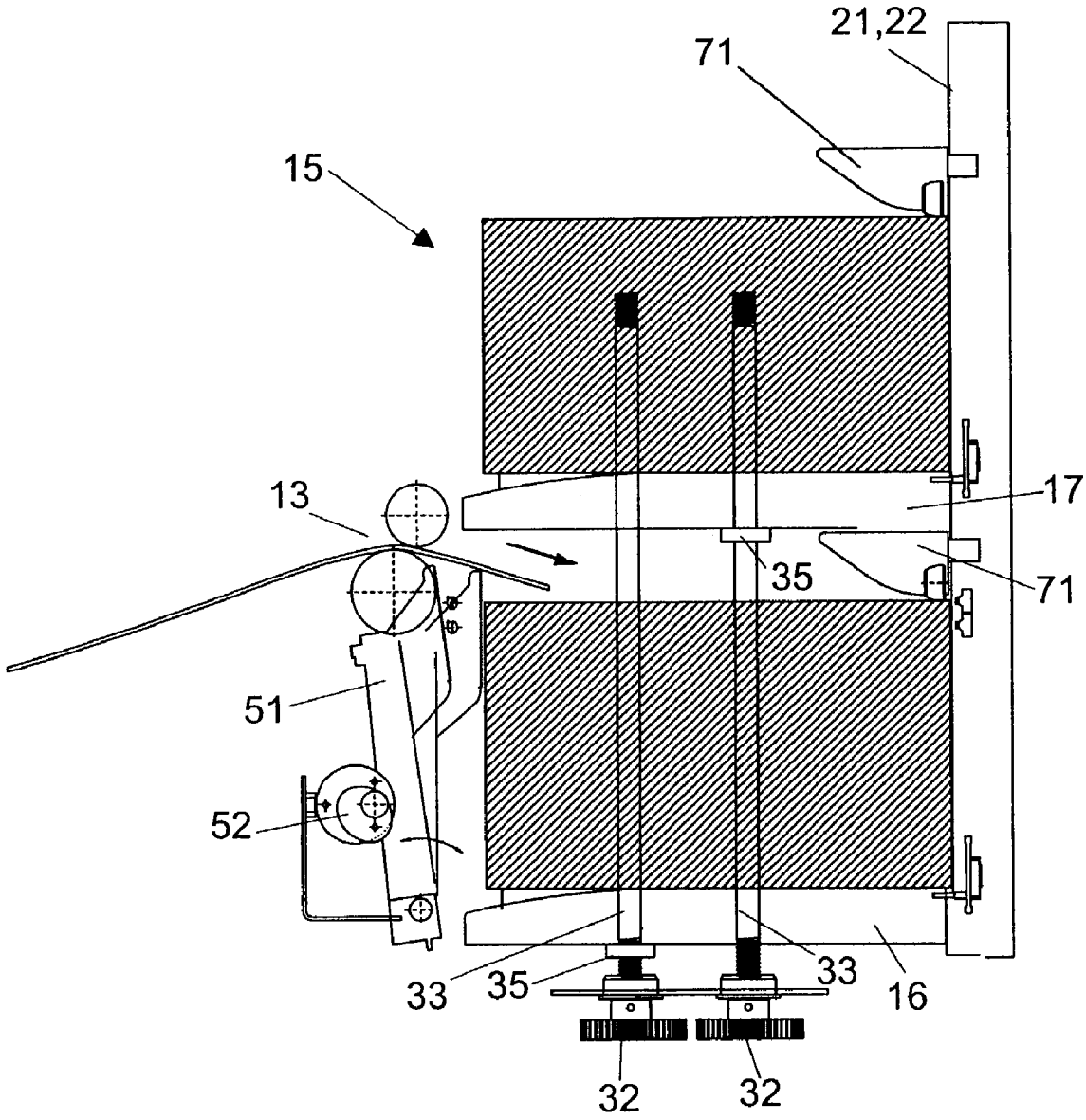
FIG. 2 is a side view, in detail, of the sheet depositing device.

The sheet depositing device 15 shown in FIG. 2 comprises two superimposed depositing platforms 16 and 17, upon which sheets are sequentially stacked. The depositing platforms are guided along a pair of guide rails 21,22 in the form of two hollow aluminum profiles that serve also as a registration barrier for supplied sheets. Each of the depositing platforms 16,17 can be set to a depositing position with respect to the horizontal discharge path formed by the discharge roller pair 13, to receive sheets discharged by the discharge roller pair 13. Each depositing platform is provided with two sheet catchers 71 for preventing incoming sheets from bouncing back, as will be described below in connection with FIGS. 4 and 5.

The vertical displacement of the depositing platforms is effected by a spindle drive system associated with each depositing platforms 16,17 (FIG. 2). Each spindle drive comprises a DC motor (not shown) driving a spindle-shaft through a reduction gearing 32. The spindle-shafts 33 driving the platforms extend vertically next to the depositing platforms. A nut 35 translating relative rotation of the spindle shaft 33 in a vertical movement embraces each spindle-shaft 33 through threaded engagement. Each nut 35 carries respective depositing platforms 16, 17.

The vertical position of the selected depositing platforms 16,17 or the sheet at the top thereof, is always just beneath the discharge path formed by the discharge roller pair 13. FIG. 2 shows the lower depositing platform 16 in a bottom depositing position in which a number of sheets are situated on the depositing platform 16 and the depositing platform 17 thereabove is in a parking position situated above the discharge path formed by the discharge roller pair 13.

Since the depositing platform 17 is adjustable as to height, independently of depositing platform 16, the depositing platform 17 can be placed in a depositing position without the lower depositing platform 16 needing to be moved further down than the bottom depositing position shown in FIG. 2.

As a result, the finishing station 11 with the sheet depositing device 15 adjacent the same, is very suitable for being disposed at the top of a printing apparatus 1, the top of which, with the scanning station 2, is situated at a normal working height for a standing operator, i.e., at about 100 cm. In the printing apparatus 1 with the finishing station 11 as shown in FIG. 1, the removal height for sheets deposited on depositing platforms 16 and 17 is between 100 cm and 160 cm for a total sheet depositing capacity of about 2400 sheets. The sheet depositing level defined by the fixed discharge rollers 13 is at approximately the 133 cm level and this level corresponds to the depositing level at which the bottom depositing platform 16 is in its bottom depositing position.

A knocker 51 is provided to produce a smooth-sided stack of sheets by knocking the edged of the stack towards the registration barrier formed by the guide rails 21, 22. An excenter mechanism 52 drives the knocker. The knocker moves rapidly and if necessary repeatedly towards the stack.

Figure 3:
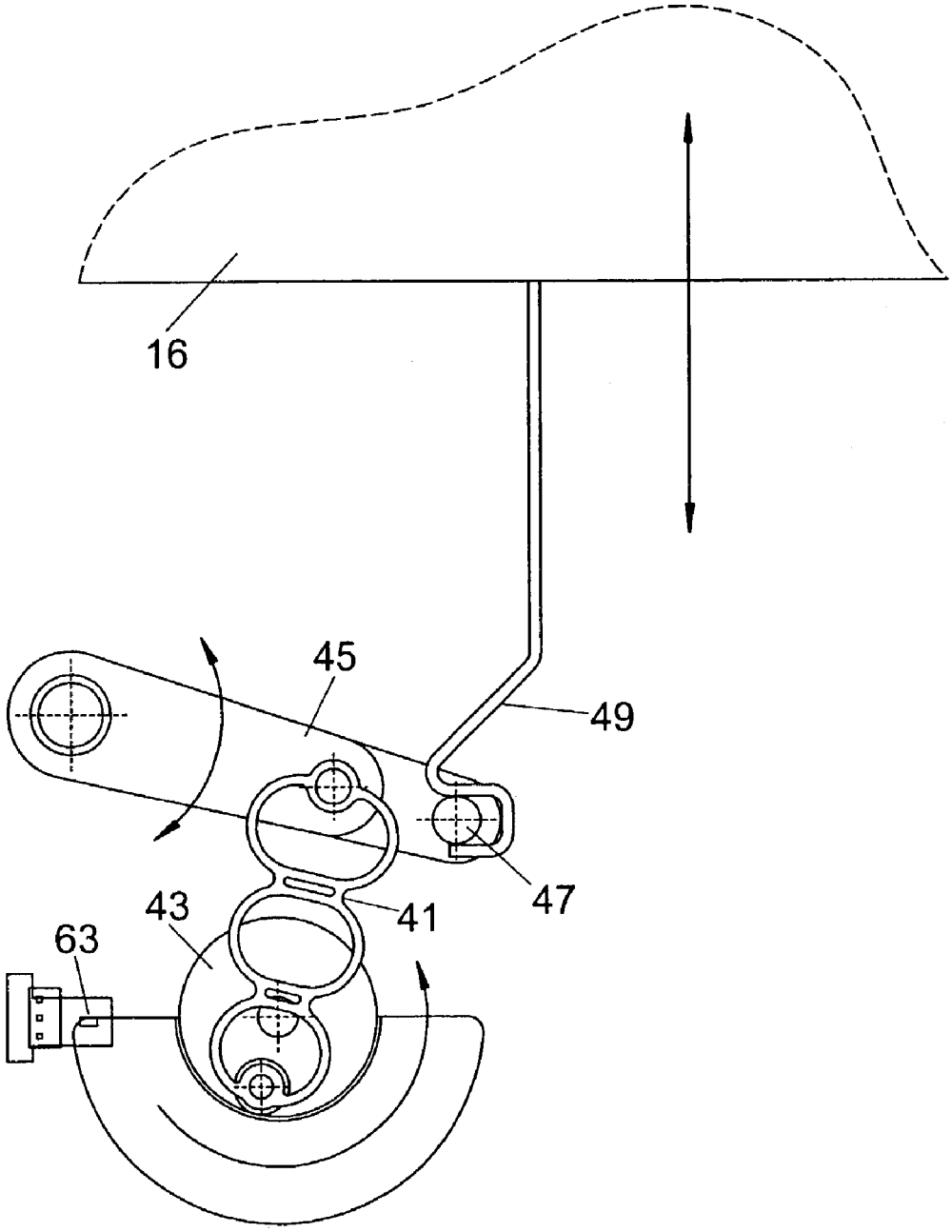
FIG. 3 is a top view, in detail, of a mechanism for creating stepped stacks.

The depositing device is equipped with a mechanism (FIG. 3) for forming stepped stacks. Hereto, the depositing platforms 16,17 move horizontally in a direction perpendicular to the feed direction between two offset positions. The depositing platform is moved to its two offset positions by an electric motor (not shown) coupled to an ordinary crank mechanism for converting the rotary movement of the electric motor into a reciprocating movement. The crank 43 is mounted on the drive shaft of the electric motor and is pivotally connected to one end of a connecting member 41. The connecting member 41 is shaped as three superimposed rings thus creating a longitudinal flexibility that allows it to function as a resilient member. The connecting member 41 is on its other end pivotally connected to a lever 45. The lever 45 is provided with a pivot rod 47 at its free end that is engaged by a hook shaped rod 49. The hook shaped rod 49 is connected to each of the depositing platforms 16,17. The pivot rod 47 extends upwardly along the full lifting height of the depositing platforms 16,17. The hook shaped rods 49 slide along the pivot rod 47 when the depositing platforms 16,17 move vertically. Half a revolution of the electric motor corresponds to a movement from one offset position to another. The position of the crank is optically detected by sensor 63. The signal of sensor 63 is send to the control device 8. The control device 8, in turn signals to stop movement, when or shortly before, an offset position has been reached.

Figure 4:
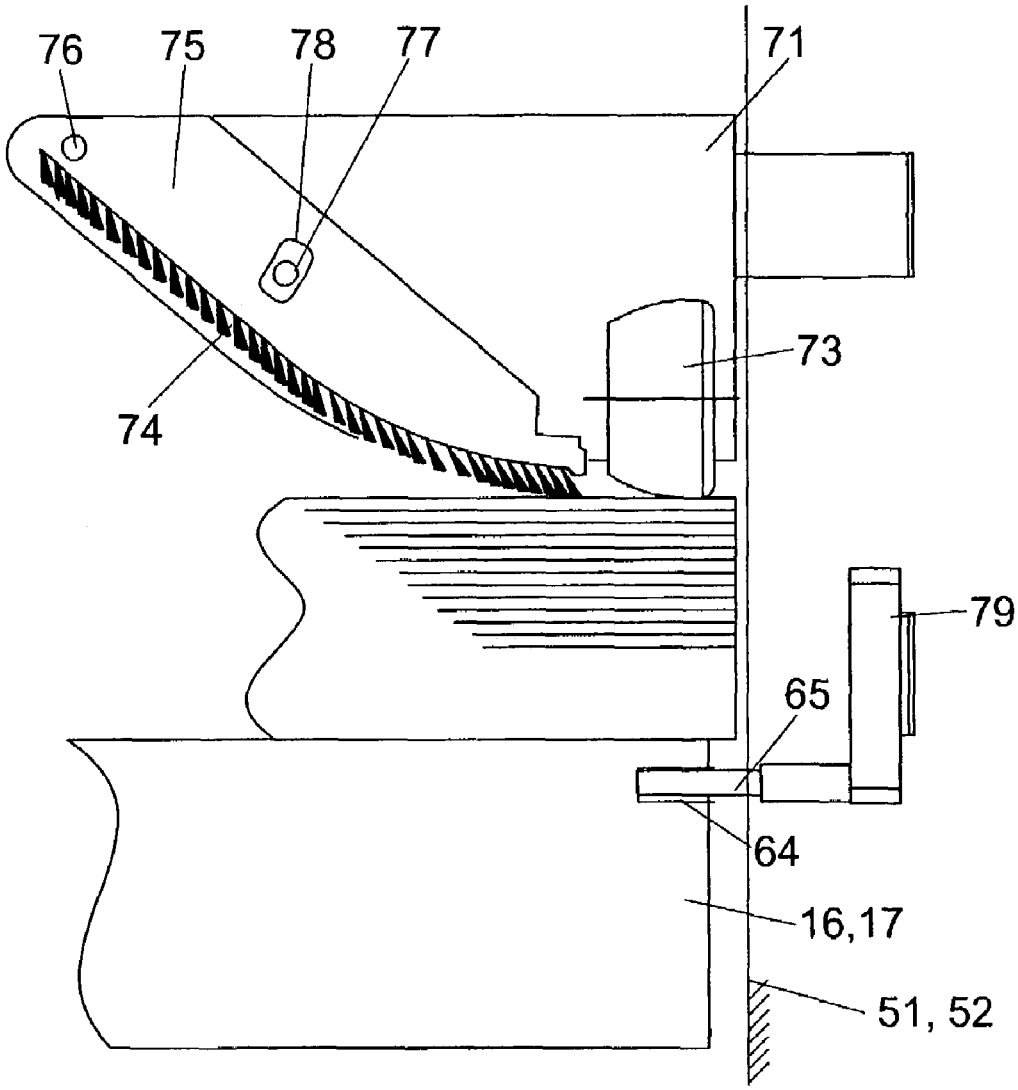
FIG. 4 is a view, in detail, of a sheet catcher.
Figure 5:
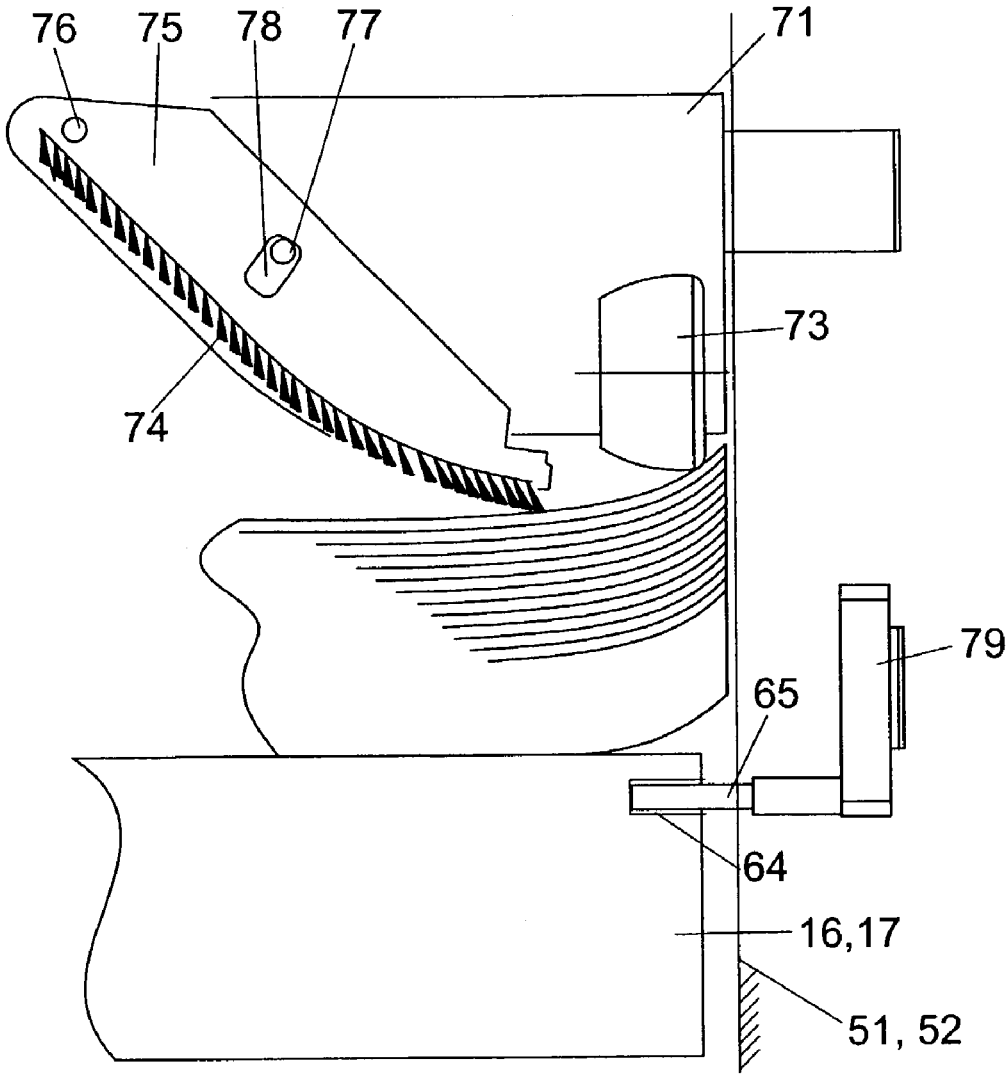
FIG. 5 is a view, in detail, of a sheet catcher when the stack is curled up against the registration barrier.
Figure 6:
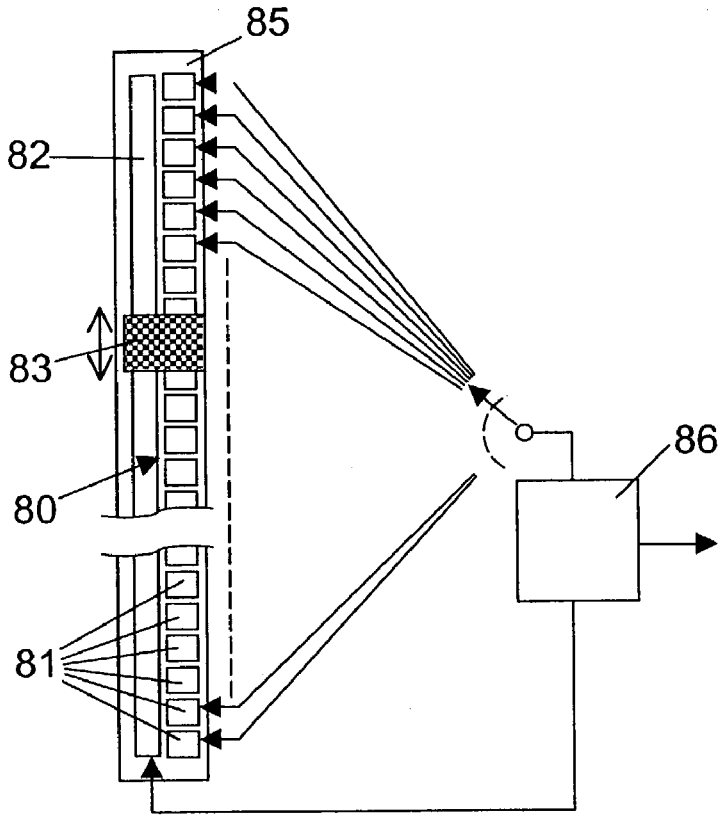
FIG. 6 shows a first embodiment of the sensor arrangement.
Figure 7:
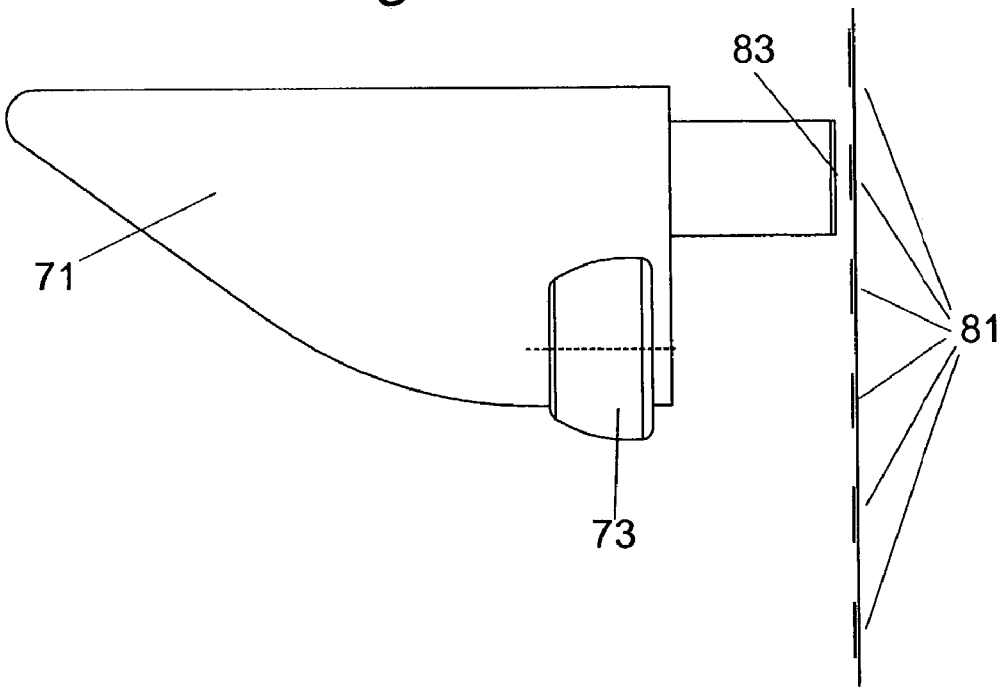
FIG. 7 shows a detail of the sensor arrangement in a first embodiment.

Each depositing platform, shown in detail in FIGS. 4 and 5, is provided with two sheet catchers 71. The sheet catchers are passively movable upwards and downwards along the guide rails and rest with their weight on the depositing platforms 16, 17, or, on a stack of sheets on the depositing platforms 16,17. A major part of the weight of the sheet catchers 71 rests on the stacked sheets/depositing surface through a roller 73. The roller 73 allows movement of the sheets relative to the sheet catchers 71 in a direction substantially perpendicular to the feed direction of the incoming sheets without applying a lateral force to the stacked sheets. This insures that the integrity of the stacked sheets remains undisturbed as the depositing platform moves laterally to offset successive sets of sheets from one another as explained with reference to FIG. 3. The rollers 73 are preferably shaped as a spherical segment or as a conical frustum for providing a sloping surface guiding the leading edge of incoming sheets under the roller.

The sheet catchers 71 are provided with a sloping surface to form a throat for trapping the leading edge of sheets fed onto the depositing platforms 16,17. The sheets are fed with a high velocity towards the sheet catchers 71. This causes the sheet to be forced under the sheet catchers 71 and the sheet catchers 71 to be elevated.

A tongue 75 is pivotally suspended from a pivot axis 76 placed towards the tip of each of the sheet catchers 71. The freely movable end of the tongue 75 rests on the stacked sheets or on the depositing platforms 16,17. Alternatively, the tongue 75 may be resiliently suspended from the sheet catcher 71 (not shown). The rotational movement of the tongue 75 is limited by a pin 77 fixed to the sheet catcher and protruding into an aperture 78 in the tongue 75.

The sheet engagement surface of the tongue is similarly sloped as the sheet catcher 71, and preferably slightly curved. The sheet engaging surface of the tongue 75 protrudes from the sheet engaging surface of the sheet catcher 71 so as to engage the leading edge of incoming sheets. The sheet catchers 71 and their tongues 75 guide the leading edge of the incoming sheet down towards the depositing platforms 16,17 or the stack on the depositing platforms 16, 17 until it abuts with the registration barriers 21,22.

The sheet engagement surface of the tongue is covered with a fabric 74 that has a low coefficient of friction in one direction and a high coefficient of friction in the opposite direction. The fabric 74 is arranged on the tongue 75 such that the incoming sheets will be exposed to the low coefficient of friction in the feed direction and to the high coefficient of friction in the opposite direction. The fabric 74 preferred for use with the present invention has sloping bristles of pile fabric. The pile fabric 74 which is preferably used on the contact surface of the tongue 75 is produced with nylons strings woven through a cotton backing to provide the intended front of the fabric, the nylon string extending between stitch apertures which are double the pile length required. These strings are then cut to produce the piles that are "panned", which is the application of a heated surface to the piles in one sense to produce a slant. As the piles have the same slant, the coefficient of friction in the slant direction is substantially lower than the coefficient of friction in the direction opposite to the slant.

The fabric 74 is placed on the tongue 75 with the slant in the paper feed direction. As the sheets are fed with high velocity, they may tend to bounce back from the depositing registration barrier after they abut with the registration barrier which is, in this embodiment formed by surfaces 51 and 52 of the two guide rails 21,22. The high coefficient of friction of the felt fabric in the direction opposite to the feed direction ensures that the sheets do not bounce back, even if they abut with the registration barriers 21,22 with some velocity.

The sheets stacked on the depositing platform tend sometimes to curl up against the registration barrier (cf. FIG. 5). The curled up stack pushes the sheet catchers further up and thus the throat is widened. In conventional sheet catchers 71 this will create a throat that is too wide to apply sufficient frictional force to prevent the sheet from bouncing back from the registration barrier. Because the tongue 75 is freely movable, its sheet engaging surface rests on the top of the stacked sheets, and will thus also be in contact with the leading edge of incoming sheets when the stacked sheets are curled up against the registration barriers 21,22.

As shown in FIG. 6 through FIG. 10, the sheet depositing device is provided with a sensor arrangement for detecting the positions of the depositing platforms 16,17 and the sheet catchers 71, shown in FIG. 2. The sensor arrangement comprises an array of active elements 80, that may be arranged within the guide rails 21,22. In a first embodiment shown in FIGS. 6 and 7, the sensor arrangement operates by capacitive detection. The array of active elements 80 is formed by regularly spaced conductive fields 81. The pitch between the conductive fields depends on the required measuring accuracy. In the exemplary arrangement, a pitch of 5 mm or less proves satisfactory. A non-conductive area is provided between consecutive conductive fields 81. A strip of conductive material 82 extends in parallel to the array of conductive fields 81. The array 80 can e.g. be manufactured on a print board. The print board 85 is placed inside guide rail 21. The upper and lower depositing platforms 16,17 and the respective sheet catchers 71 are provided with the passive element of the sensor arrangement in the form of a conductive plate 83. The conductive plates 83 are arranged such that their horizontal extension is sufficient to cover substantially the conductive strip 82 and a conductive field 81. The vertical extent of the conductive plates 83 determines the reliability and the resolution of the measured value. A vertical dimension of twice the pitch between the conductive fields proved to give satisfactory results. The conductive plates 83 are guided in guide rail 21. The conductive plates 83 on the sheet catchers 71 are directly attached to a member of the sheet catcher that protrudes into the guide rail 21. The conductive plates 83 that move in unison with the depositing platforms 16,17 are attached to a carrier member 79 (FIG. 4). The carrier member 79 is guided in the guide rail 21. A pin 65 extends from the carrier member 79 into a nut 64 in the respective depositing platforms 16, 17. The laterally extending nut allows the depositing platform to move laterally for creating stepped stacks as described above. When the conductive plate 83 moves up or down with the respective depositing platforms 16,17 or sheet catcher 71 it moves at a short distance over the conductive strip 82 and alternately over conductive fields 81 and the non-conductive areas between the conductive fields 81.

A sub-control unit 86 measures the electrical capacity between each of the conductive fields 81 and the conductive strip 82. When the conductive plate 83 covers a conductive field 81 and the conductive strip 82, the electrical capacity associated with that specific conductive field is much larger than the capacity associated with a non-covered conductive field. The sub control unit 86 measures the electrical capacity associated with each conductive field 81 and converts the signals from the sensor array 80 to a position signal which is sent to the control device 8. Alternatively, the strip of conductive material 82 may be replaced by a second array of conductive fields extending in parallel with the first array of conductive fields (not shown). In this embodiment the sub control unit 86 measures the capacities of the pairs of conductive fields from the arrays 81 and 82, respectively.

Figure 8:
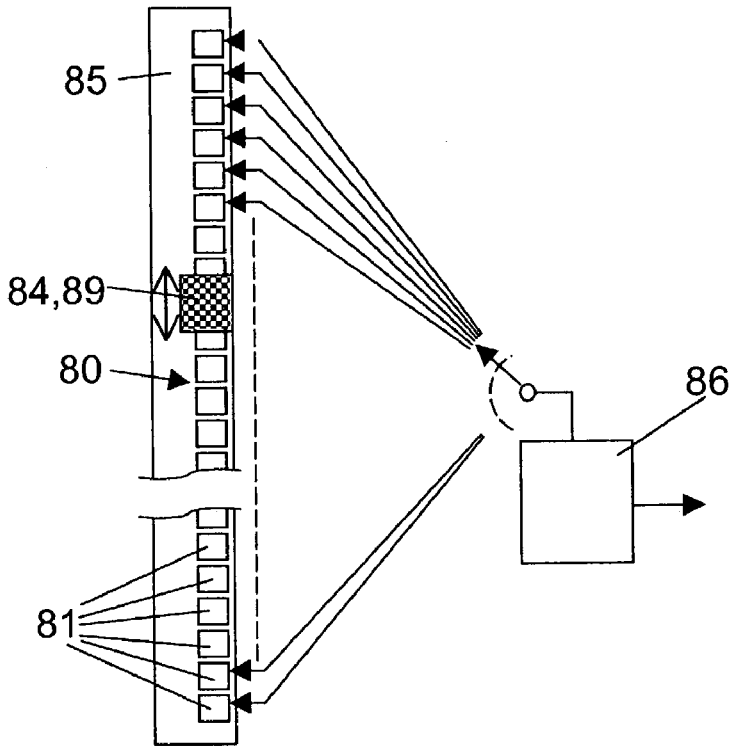
FIG. 8 shows a second and third embodiment of the sensor arrangement.
Figure 9:
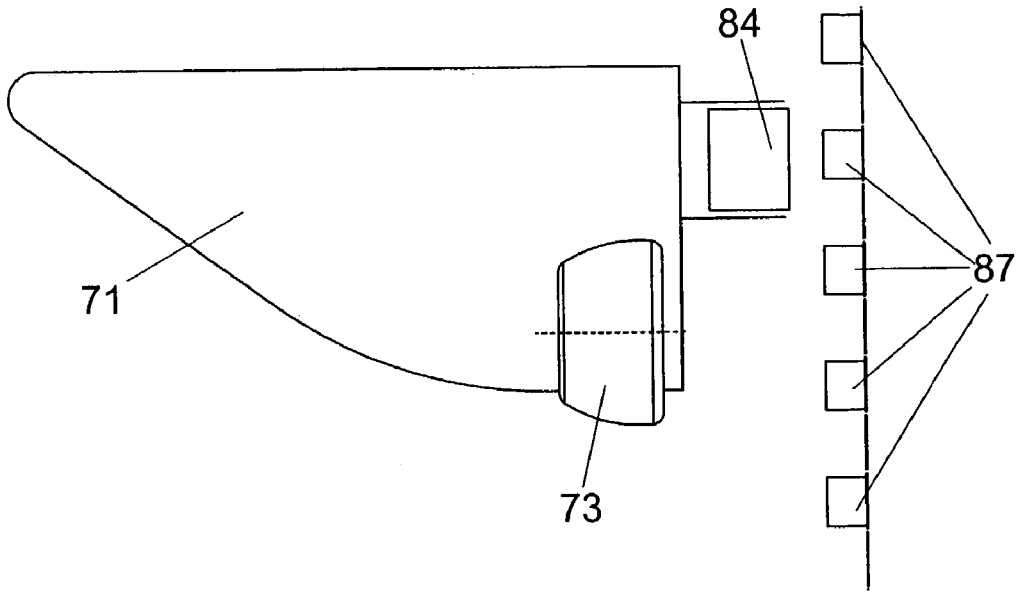
FIG. 9 shows a detail of the sensor arrangement in a second embodiment.

In a second preferred embodiment shown in FIGS. 8 and 9, the sensor arrangement operates with the Hall effect. The array of active elements is built up of an array of regularly spaced hall sensors 81. The upper and lower depositing platforms 16,17 and the respective sheet catchers 71 are provided with the passive element of the sensor arrangement in the form a magnet 84. When the magnet 84 moves up or down with the respective depositing platforms 16,17 or sheet catcher 74, it moves at a short distance over the hall sensors 81. In the sub control 86 unit the signals from the hall sensors are converted to a positional signal and sent to the control device 8.

Figure 10:
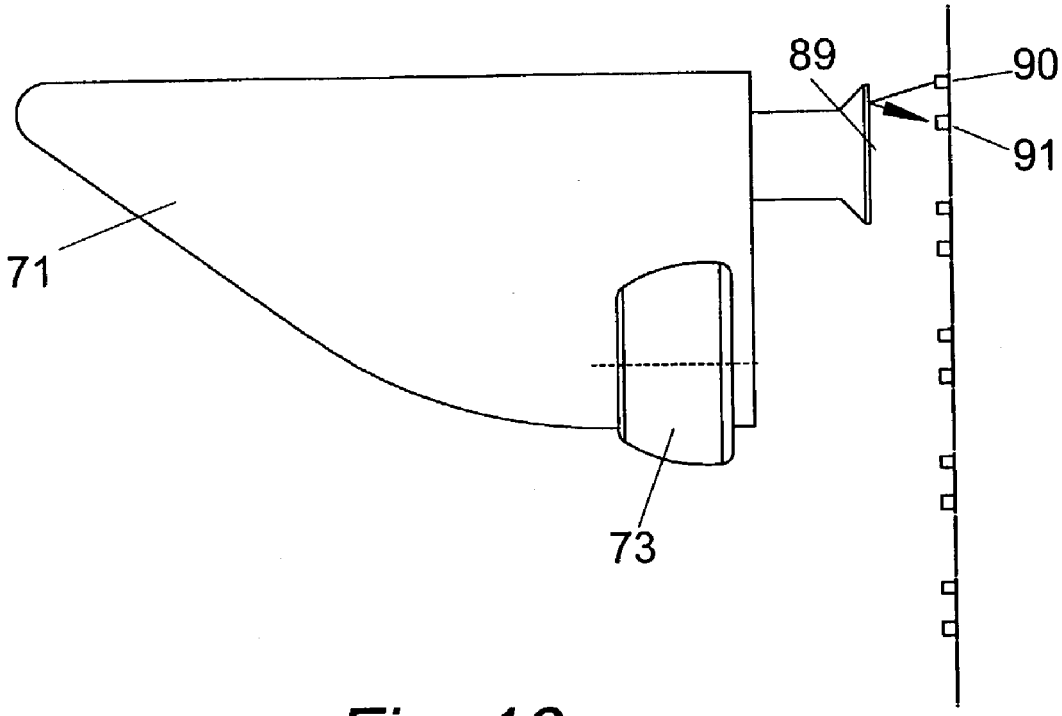
FIG. 10 shows a detail of the sensor arrangement in a third embodiment.

In an alternative embodiment shown in FIGS. 8 and 10, the sensor arrangement operates with light. The array of active elements is built up of an array of regularly spaced sensors 81, each comprising an LED 90 and a photocell 91. The upper and lower depositing platforms 16, 17 and the respective sheet catchers 71 are provided with the passive element of the sensor arrangement in the form a reflector 89. When the reflector 89 moves up or down with the respective depositing platforms 16,17 or the sheet catcher 71, it moves over the sensors and reflects the light emitted by the LED 90 of the sensor that it is facing to the respective photocell 91. The photocells 89 are connected to the sub control unit 86, which converts the signals into a positional signal and sends it to the control device 8. Although the LED-photocell-pairs are shown as vertical arrangements in FIG. 10, it will be clear that they may also be arranged horizontally or in any other direction.

The catchers 71 will always rest on the stack. Both the position of the sheet catchers 71 and the depositing trays 16, 17 are known. Thus, the distance between the depositing platforms 16, 17 and the sheet catcher 71 can be used to determine the stack height. This information is used by the control device 8 to determine when a depositing platforms 16,17 is full, e.g. to change to the other depositing platforms 16,17, or when both depositing platforms are full, to issue an alarm that the stacking device needs to be emptied.

Figure 11:
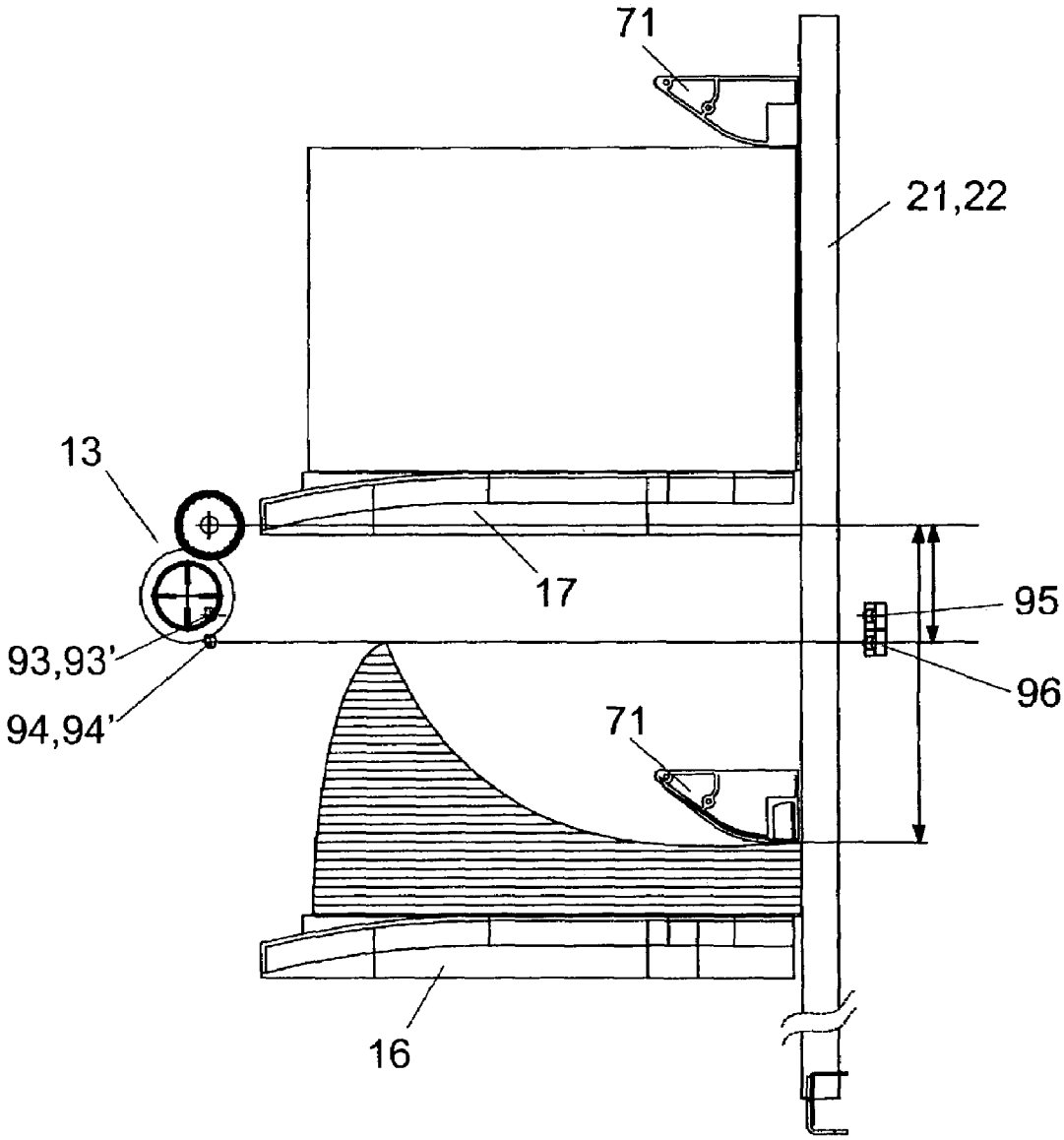
FIG. 11 is a side view in detail on the sheet depositing device illustrating height sensors and curl of the stack in the feed side.

Height detectors as shown in FIG. 11 ensure that the upper edge of a stack of deposited sheets on the active depositing platforms 16, 17 is always at the correct height to receive a new sheet from the discharge roller pair 13 by adjusting the position of the depositing platforms 16, 17. The height detectors are formed by two superimposed sensors. One sensor comprises a pair of LEDs 93,93' and a single photocell 95, and the other sensor comprises a pair of LEDs 94,94' and a single photocell 96. Other numbers of photocells may be contemplated, e.g. one photocell for each LED, or a single photocell for all four LEDs (that would then be operated in a phase-shifted pulsated manner). The pair of LEDs 93,93' (94,94') of the respective sensor direct a substantially horizontal light bundle from the feed side of the stack towards the respective photocell 95 (96) at the registration barrier side of the stack. The LEDs 93,93' (94, 94) in one pair are spaced laterally apart. The respective photocell 95 (96) is arranged in the lateral midpoint of the stack. The LEDs 93,93' (94, 94') therefore direct two light beams diagonally over the stack towards each of the photocell 95 (96). The output of the photocell 95 (96) is active only when it receives light from both LEDs 93,93' (94,94').

The photocells 95,96 are connected to the control device 8. A first pair of LEDs 94,94' and first photocell 96 are arranged at the minimum depositing height, whereas a second pair of LEDs 93,93' and second photocell 95 are arranged at the maximum depositing height. When the output of the first photocell 96 is active, the control device 8 powers the respective DC motor to raise the active depositing platforms 16,17 until the first photocell 96 becomes inactive. When the second photocell 95 becomes inactive, the control device 8 powers the respective DC motor to lower the active depositing platforms 16,17 until the second photocell 95 becomes active. When the depositing platforms 16,17 is in the correct position, the output of the first photocell 96 should be inactive and output of the second photocell 95 should be active.

While feeding a sheet onto the stack, the height detectors are deactivated for a short period because the incoming sheet will obstruct the LEDs 93,93', 94,94'.

The stacked sheets sometimes tend to form a curl on the feed side of the stack, which is aggravated by e.g. staples which make the stack grow faster on the staple side. The effect is illustrated in FIG. 11. The height detectors ensure that the active depositing platforms 16,17 will be lowered to compensate for the curl to ensure that the sheets fed by the discharge roller pair 13 do not hit the side of the stack. This may lead however to a situation, e.g. when the curl on the feed side is large, in which the sheet catchers 71 are positioned too low with respect to the discharge roller pair 13, and the leading edge of the incoming sheets will not be caught under the sheet catchers 17, but instead pass above the sheet catchers 71. In this situation the control over the stacking process will be completely lost. The control device 8 compares therefore the height of the sheet catchers 71 with the height of the feed roller pair 13, and if the height difference between the sheet catchers 71 and the feed roller pair exceeds a preset threshold, the feeding process is stopped and an alarm is set.

Although the present invention has been described by an embodiment with two depositing platforms and two guide rails, it is clear to those skilled in the art, that this is merely an example of a preferred embodiment of the present invention. It is e.g. possible to use only one guide rail, one platform, or to use more than two guide rails or more than two platforms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet depositing device for depositing sheets or sets of sheets fed sequentially from a paper processing apparatus, said sheet depositing device comprising:

a depositing platform for feeding the sheets thereto and against a registration barrier, a sheet catcher positioned close to the registration barrier and adapted to engage the leading edge of incoming sheets before they abut against the registration barrier, said sheet catcher being freely movable in a direction substantially perpendicular to said sheet depositing platform and adapted to rest on said depositing platform or, if there are sheets stacked on said depositing platform, on said sheets, containing the platform or the sheets near the registration barrier; and a sheet engaging member freely suspended from said sheet catcher and adapted to rest on said depositing platform or on sheets stacked thereon, contacting the platform or said sheets at a short distance from the registration barrier.

2. The sheet depositing device according to claim 1, wherein said sheet engaging member is resiliently suspended from said sheet catcher.

3. The sheet depositing device according to claim 1, wherein the sheet catcher is adapted to rest on said depositing platform or adapted to rest on the stacked sheets via a roller that allows relative lateral movement between said depositing platform and the sheet catcher without applying any substantial lateral force, said roller being shaped as a spherical segment or as a conical frustum for providing a sloping surface for guiding the leading edge of incoming sheets under the roller.

4. The sheet depositing device according to claim 1, wherein the sheet engaging member includes a tongue.

5. The sheet depositing device according to claim 4, wherein the tongue is pivotally suspended from the end portion of said sheet catcher.

6. The sheet depositing device according to claim 4, wherein the tongue has a sheet engagement surface which is sloped to form a throat for trapping the leading edge of incoming sheets.

7. The sheet depositing device according to claim 6, wherein the sheet engagement surface is covered with a fabric having a low coefficient of friction in the direction in which the sheets are introduced and a high coefficient of friction in the opposite direction.

8. The sheet depositing device according claim 1, wherein the sheet catcher is movable along a guide.

9. The sheet depositing device according to claim 8, wherein the sheet depositing platform is movable along said guide.

10. The sheet depositing device according to claim 1, wherein the sheet catcher is movable along two or more parallel guides.

11. The sheet depositing device according to claim 1, wherein a plurality of superimposed sheet depositing platforms and corresponding sheet catchers are utilized.

12. A paper processing apparatus operatively connected with a sheet depositing device of claim 1.

13. The paper processing apparatus of claim 12, wherein said apparatus is a printing apparatus.

14. The paper processing apparatus of claim 12, wherein said apparatus is a copying apparatus.

15. The sheet depositing device of claim 1, further containing a sensor arrangement for detecting the positions of the sheet depositing platforms and the sheet catchers.

16. The sheet depositing device of claim 15, wherein the sensor arrangement comprises an array of active elements arranged within guide rails and passive elements detectable by the active elements, guided in the guide rails.

17. The sheet depositing device of claim 16, wherein the passive elements are operatively associated with the sheet catchers or sheet depositing platforms and extends into the guide rail.

18. The sheet depositing device of claim 17, wherein the array of active elements and the passive elements establish a position signal which is sent to a control device.

19. The sheet depositing device of claim 18, wherein the passive elements is a magnet.

20. The sheet depositing device of claim 19, wherein the passive element is a conductive plate.

21. The sheet depositing device of claim 15, wherein the sensor arrangement comprises an LED-photocell system.

22. A method of depositing sheets or sets of sheets fed sequentially from a paper processing apparatus onto a depositing platform having a registration barrier at its end, which comprises:

feeding the sheets onto the depositing platform and under a sheet catcher situated close to the registration barrier until the sheets abut against the registration barrier, said sheet catcher being freely movable in a direction substantially perpendicular to said sheet depositing platform and adopt to rest on said depositing platform or, if there are sheets stacked on said depositing platform, on said sheets, and contacting the platform or the sheets stacked thereon near the registration barrier; and arresting each sheet, when it abuts against the registration barrier, with a sheet engaging member that is freely suspended from said sheet catcher and is adapted to also rest on said depositing platform or on sheets stacked thereon, contacting the platform or said sheets at a small distance from the registration barrier.

23. A sheet depositing device for depositing sheets or sets of sheets fed sequentially from a paper processing apparatus onto at least one sheet depositing platform and against a registration barrier, said sheet depositing device comprising a sheet catcher adapted to rest on said sheet depositing platform or adapted to rest on sheets stacked on said sheet depositing platform, said sheet catcher being freely movable linearly along a guide in a direction substantially perpendicular to said sheet depositing platform and adapted to engage the leading edge of incoming sheets before they abut against said registration barrier, wherein a sheet engaging member is suspended from said sheet catcher.

* * * * *